US007966906B2

(12) United States Patent
Bennett et al.

(10) Patent No.: US 7,966,906 B2
(45) Date of Patent: Jun. 28, 2011

(54) FLUID FLOW CONTROL DEVICE OPERATOR

(75) Inventors: Mark A. Bennett, Lagrange, OH (US); Jeffrey M Geither, North Ridgeville, OH (US)

(73) Assignee: Bendix Commercial Vehicle Systems LLC, Elyria, OH (US)

( * ) Notice: Subject to any disclaimer, the term of this patent is extended or adjusted under 35 U.S.C. 154(b) by 1229 days.

(21) Appl. No.: 11/639,966

(22) Filed: Dec. 15, 2006

(65) Prior Publication Data

US 2008/0141822 A1 Jun. 19, 2008

(51) Int. Cl.
*G05G 1/10* (2006.01)

(52) U.S. Cl. ..... 74/553

(58) Field of Classification Search ..... 74/543, 74/548, 553; 251/291, 319; 250/465.1; 292/347, 292/348; 40/331, 299.01; 200/329, 332.1, 200/341, 345

See application file for complete search history.

(56) References Cited

U.S. PATENT DOCUMENTS

| | | | | |
|---|---|---|---|---|
| 4,512,092 | A | 4/1985 | McLaughlin et al. | |
| 4,779,305 | A * | 10/1988 | Gorsek | 16/441 |
| 4,790,208 | A | 12/1988 | Johnson | |
| 4,801,769 | A | 1/1989 | Cummings | |
| 5,364,065 | A * | 11/1994 | Tauati | 251/96 |
| 5,735,147 | A * | 4/1998 | Cattanach et al. | 70/164 |
| 6,685,281 | B2 | 2/2004 | MacGregor | |
| D499,677 | S | 12/2004 | Kemer | |
| 7,568,677 | B2 * | 8/2009 | Geither et al. | 251/291 |
| 2004/0032311 | A1 | 2/2004 | Forsythe | |

FOREIGN PATENT DOCUMENTS

| | | |
|---|---|---|
| FR | 2538467 | 6/1984 |
| FR | 2539247 | 7/1984 |
| FR | 2693285 | 1/1994 |
| WO | 2006012545 A2 | 2/2006 |

OTHER PUBLICATIONS

European Search Report and Opinion for EP Application No. 07122417.4-1252, dated Mar. 31, 2008.
Bendix Service Data Sheet No. SD-03-3412 for Bendix MV-2 Control Module pp. 1-4, Published Mar. 2004.

* cited by examiner

*Primary Examiner* — Vicky A Johnson
(74) *Attorney, Agent, or Firm* — Calfee, Halter & Griswold LLP

(57) ABSTRACT

Three elements of a fluid flow control device—switch, button, label—are designed to minimize the possibility of two labeled buttons being swapped on their switches. If the parts are assembled incorrectly or mislabeled, or if the buttons are thereafter swapped on the switches, it will be very obvious; then, if one attempts to fix such a problem, it can only be fixed by placing the buttons on the correct switches, and it can not be fixed by leaving the buttons on the wrong switches.

15 Claims, 4 Drawing Sheets

FLUID FLOW CONTROL DEVICE OPERATOR

BACKGROUND OF THE INVENTION

The invention relates to operators for fluid flow control devices, such as valves, for example. In particular, this invention relates to operators for air valves, for example of the type including a manually engageable button mounted on a plunger for controlling the position of the plunger and thus the operation of the valve.

U.S. Pat. No. 4,790,208 shows a knob and shaft assembly for operating, for example, a vehicle air brake control valve. The assembly includes a knob having a front face and a barrel projecting from the face, and a shaft which is threadedly engaged with threads on the barrel. The assembly is provided with locking detents comprising protrusions on the shaft which are received within apertures on the barrel to releasably lock the knob to the shaft, thereby preventing the parts from being accidentally becoming disengaged. This also helps to assure the proper orientation of the knob with respect to the shaft to permit indicia embossed on the knob to be easily read by the operator.

In some vehicles, for example tractor-trailers with air brake systems, there is a module or assembly in which there are two vehicle air flow control devices (referred to herein as "switches") next to each other, forming the assembly. The switches have plungers on which the switch buttons are mounted, with labels on the buttons.

In one such switch assembly, one device is labeled as a "red" switch, that is to be installed in a vehicle dashboard for controlling trailer air supply. The other device is labeled as a "yellow" switch, that is to be installed in a vehicle dashboard for controlling a different function, for example, parking brake. The switches are different colors to distinguish them.

Depending on the vehicle, the switch assembly can be mounted in the vehicle cab in either a horizontal (two switches left and right) orientation, or in a vertical orientation. In either case, when the switch assembly is in the installed position, the labels on the two buttons must be upright—that is, the text on the labels must be oriented upright for reading by the driver.

The buttons and switches may be manufactured so that either button can physically fit onto either switch, to minimize the number of unique parts, for cost purposes. In such a case, it is important that the buttons for the red and yellow switches not be swapped on their switches, to prevent having the incorrect switch be activated when the supposedly correct button is engaged.

SUMMARY OF THE INVENTION

In accordance with the present invention, the three parts—switch, button, label—are designed to minimize the possibility of two labeled buttons being swapped on their switches. The invention provides a method and apparatus that ensures that if the parts are assembled incorrectly or mislabeled, or if the buttons are thereafter swapped on the switches, it will be very obvious; then, if one attempts to fix such a problem, it (a) can only be fixed by placing the buttons on the correct switches, and (b) it can not be fixed by leaving the buttons on the wrong switches.

DETAILED DESCRIPTION OF EXEMPLARY EMBODIMENTS

At least two similar air flow control devices (FIG. 1) are provided, each having a plunger with a button. In the illustrated embodiment, the airflow control devices are designated 10*r* and 10*y*. The device 10*r* has a plunger 12*r* with a button 14*r*. The device 10*y* has a plunger 12*y* with a button 14*y*.

The device designated 10*r* is a "red" switch, that is to be installed in a vehicle dashboard for controlling a particular function for example, trailer air supply. The device designated 10*y* is a "yellow" switch, that is to be installed in a vehicle dashboard for controlling a different particular function, for example, parking brake. It is important, as discussed above, that the control buttons for the red and yellow switches

10*r* and 10*y* not be swapped, to prevent having the incorrect switch be activated when the supposedly correct button is engaged.

By "similar" is meant that the two devices 10*r* and 10*y*, although they may operate differently and control different functions, are effectively the same as to their plunger configurations. Thus, if a button physically fits on a plunger of one device 10*r* or 10*y*, it will physically fit on the plunger of the other device 10*y* or 10*r*. The flow control devices may be similar or, in some cases, even identical, to minimize the number of unique parts, for cost purposes.

Each button (control button) 14*r* or 14*y* is an item that is manually engaged by the driver to apply force for changing the state of the associated flow control device. The "plunger" 12*r* or 12*y* is the portion that receives force from an associated button to operate the device. It could be a portion that moves in and out, for example, in an air valve; it could be a portion that rotates; etc.

Figure 1:
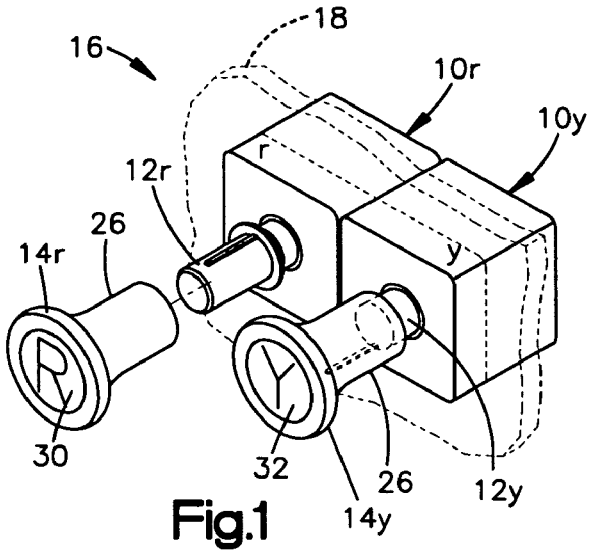
FIG. 1 is a perspective view illustrating exemplary "red" and "yellow" switches with control buttons installed thereon, as mounted in a horizontal orientation in a vehicle dashboard portion that is shown in dashed lines.
Figure 2:
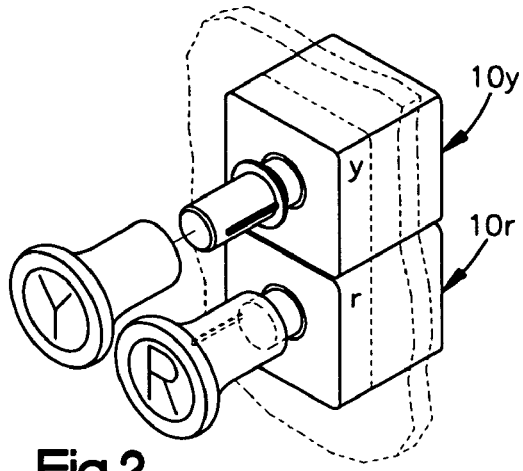
FIG. 2 is a perspective view similar to FIG. 1 and illustrating the "red" and "yellow" switches as mounted in a vertical orientation in the vehicle dashboard portion.

The devices 10*r* and 10*y* could be two air valves, or two electric switches. The two devices 10*r* and 10*y* could be in one housing with two projecting plungers. The two devices 10*r* and 10*y* together form a "switch assembly" 16. In one embodiment, the devices 10*r* and 10*y* are push-pull air valves and the plunger is a shaft that moves in and out in the valve. In FIG. 1, the two devices 10*r* and 10*y* are shown mounted in a horizontal orientation in a vehicle dashboard portion shown in dashed lines 18. In FIG. 2, the two devices 10*r* and 10*y* are shown mounted in a vertical orientation in the vehicle dashboard portion 18.

Figure 3:
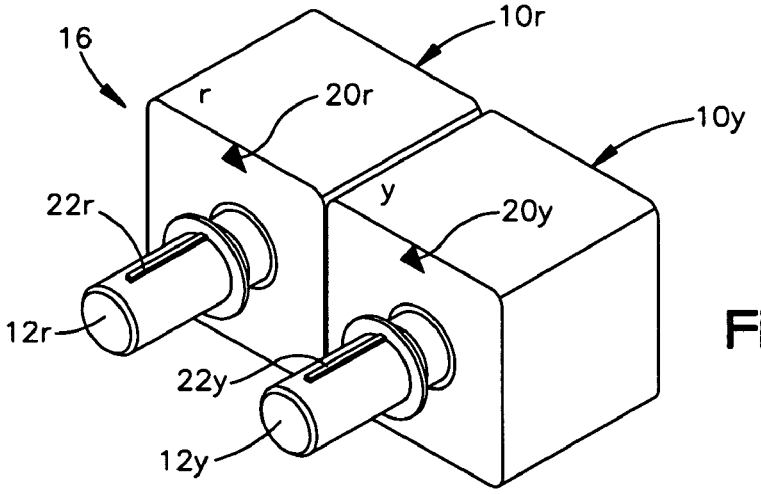
FIG. 3 is a schematic illustration of the red and yellow switches as shown in a first, identical, orientation, prior to mounting of their control buttons thereon.

Each device 10*r* and 10*y* (FIG. 3) has an orientation feature (such as a timing mark) which may be provided on a housing of the device, for example, or which may be provided elsewhere. In the illustrated embodiment, the device 10*r* has a timing mark 20*r*, and the device 10*y* has a timing mark 20*y*. The orientation feature enables an assembler to orient the device as a whole so that the device, and its plunger, is in a certain orientation (for example, relative to vertical/upright) when the switch assembly is being assembled on a desk or bench or in a housing or in a vehicle dashboard.

The plunger 12 of each device 10 has a button orientation feature—pin, track, detent, slot, etc. The button orientation feature is designed to interact with a feature on a button that is placed on the plunger, to help ensure proper orientation of the button on the plunger. Such orientation of the button on the plunger is independent of the orientation of the device as a whole. In the illustrated embodiment, each plunger has an axially extending rib that serves as the button orientation feature. Thus, the plunger 12*r* of the device 10*r* has a button orientation feature 22*r*, and the plunger 12*y* of the device 10*y* has a button orientation feature 22*y*. In each case the button orientation feature 22 is at a particular circumferential location about the axis of the plunger 12, relative to the timing mark 20 of the device 10 itself.

Figure 4:
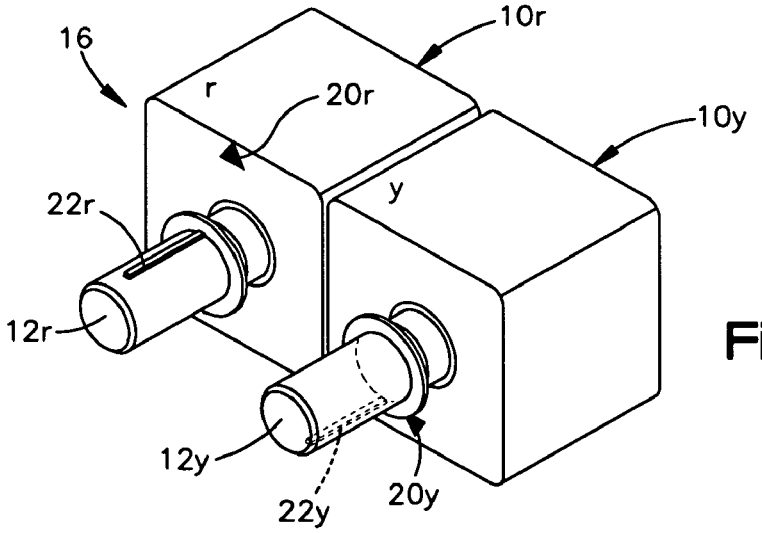
FIG. 4 is a schematic illustration similar to FIG. 3 showing the yellow switch in a second orientation, prior to mounting of the control buttons.

When the two devices 10*r* and 10*y* are assembled together for use in a vehicle, they are oriented 180° apart, as shown in FIG. 4. As a result, the button orientation features 22*r* and 22*y* on the plungers 12*r* and 12*y* are 180° apart, also.

Figure 5:
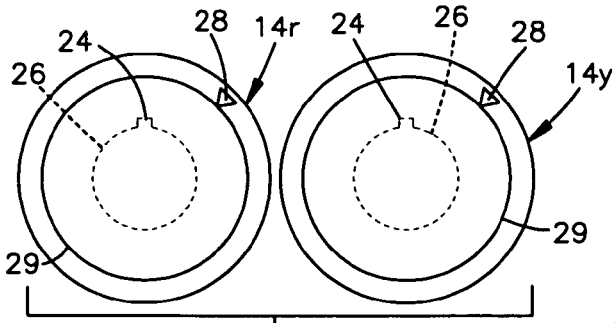
FIG. 5 is a front elevational view of two similar red and yellow control buttons in an identical orientation, without labels.

At least two similar (or identical) buttons (FIGS. 1, 2 and 5) are provided, each having a portion 26 for engaging a plunger and supporting the button on the plunger, such as a hub, for example. The buttons may be identical, to minimize the number of unique parts, for cost purposes. Each button 14*r* and 14*y* also has a plunger orientation feature 24 on or inside its hub 26, or otherwise associated with the button—such as a pin, track, detent, slot, etc.—that can engage a button orientation feature on the plunger with which it is associated. In each button the plunger orientation feature is at a particular circumferential location about the axis of the button. In the illustrated embodiment, for example, each button has a slot 24 for receiving a rib 22 of a plunger 12.

Each button also has a label space 29 for receiving a label, such as, for example, an adhesive label. In the illustrated embodiment, the label spaces 29 are circular. Each button 14*r* or 14*y* has a timing mark 28 at or near or adjacent its label space 30. The timing mark 28 is used as described below to help orient a label on the button. In each button the timing mark 28 is at a particular circumferential location about the button, relative to the plunger orientation feature 24 of the button.

At least two labels (FIG. 6) are provided. In the illustrated embodiment, the labels are designated 30 and 32. The labels 30 and 32 are to be associated via buttons with the switches 10*r* and 10*y*, respectively, so that if the button with the red label is engaged, the red switch is actuated, and if the button with the yellow label is engaged, the yellow switch is actuated.

The labels 30 and 32 are different from each other, having different visual indicia such as color and symbols and words, to indicate the different function of the device on which the label is placed. This concept is brought out in the illustrated example, in which one label 30 is red, with the letter R thereon, and is used on a device 10*r* that controls trailer air supply, while the other label 32 is yellow with the letter Y thereon, and is used on a device 10*y* that controls parking brake. Otherwise, the labels 30 and 32 may have the same configuration or shape, that is, both being circular, for example, as shown, to minimize cost.

Figure 6:
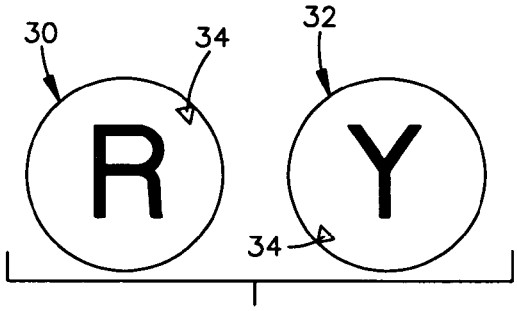
FIG. 6 is a front elevational view of red and yellow labels in a rotated orientation.

Each label 30, 32 has a respective timing mark 34 for association with a timing mark 28 of a button. The timing mark 34 is used as described below to help orient the label in a particular rotational position on a button. Between the two labels 30 and 32, the timing marks 34 may, as shown in FIG. 6, be located differently relative to the upright orientation of the lettering on the labels.

One step in the assembly process (FIG. 7), which may be the first step, is to add (place or position) the labels onto the buttons. This is done by taking a label (either one) and a button (either one), aligning its timing mark with the timing mark on the selected button, and affixing the label to the selected button. The process is then repeated with the other label and the other button. During this step, it does not matter which label goes on which button, as the buttons are identical to each other.

Figure 7:
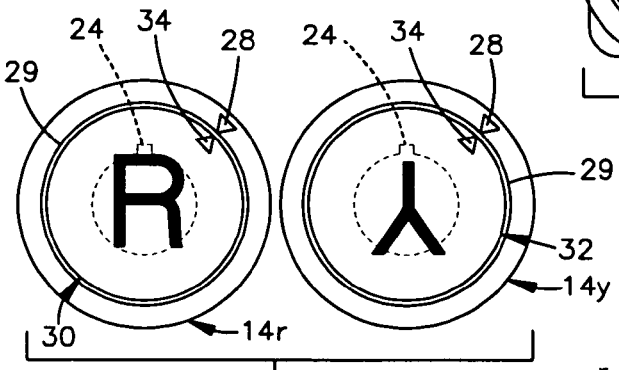
FIG. 7 is a front elevational view of the red and yellow labels as installed on the red and yellow buttons shown in FIG. 5, illustrating how the yellow label is thus upside down.

In the illustrated example, the label 30 is placed on the button 14*r*, and the label 32 is placed on the button 14*y*, aligning their timing marks 34 and 28 as shown. The step of aligning the timing marks 34 and 28 on the yellow button 14*y* and label 34, and the timing marks 34 and 28 in the red button 14*r* and label 32, causes one of the two labels (in this case the yellow label 32) to appear to read "upside down" if the two identical buttons are oriented the same as each other as shown in FIG. 7.

With the "R" label 30 on the button 14*r*, that button 14*r* becomes a "Red" button. Similarly, with the "Y" label 32 on the other button 14*y*, that button 14*y* becomes a "Yellow" button.

Another step in the assembly process (FIGS. 8 and 9), which may be the next step, is to assemble the buttons onto the air flow control devices—specifically, on the device plungers. First, the devices 10*r* and 10*y* are oriented 180° apart by using the device orientation features. For example, if the devices 10*r* and 10*y* are being assembled on a generally horizontal work surface, the devices can be oriented with one device orientation feature 20 at the top and one at the bottom, as shown schematically in FIG. 4.

The plungers as noted above have button orientation features 22 for receiving and engaging the buttons, features that are orientation specific. When the two devices are oriented 180° apart in this manner, these button orientation features 22 on the plungers 12 are, as a result, 180° apart.

Figure 8:
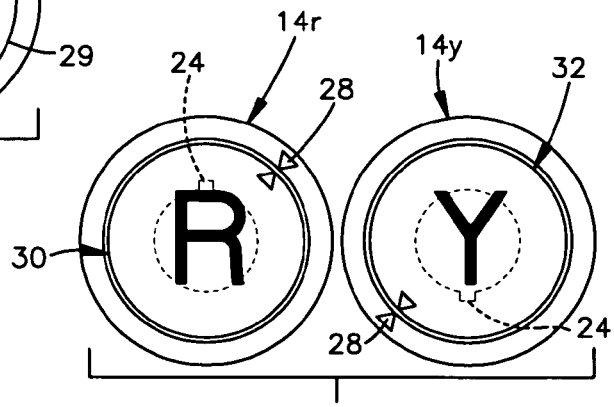
FIG. 8 is a view similar to FIG. 7 with the yellow button and label rotated 180 degrees to be upright.

When the labeled buttons 14*r* and 14*y* are installed onto the plungers, the buttons are to be set to particular rotational positions on the plungers. Specifically, the required or desired positions are ones in which, for each button/switch combination, the text is upright. This can be done as shown in FIG. 8, for example, which shows the "yellow" button 14*y* and its associated label 32 have been rotated 180° relative to the button 14*r* so that the indicia on the yellow button is "upright".

With the two devices 10*r* and 10*y* (FIG. 9) (and their plungers 12*r* and 12*y*) already oriented 180° apart, as shown in FIG. 4, the buttons 14*r* and 14*y* are then installed on the plungers with the slots 24 in the buttons receiving the ribs 22 on the plungers.

Figure 9:
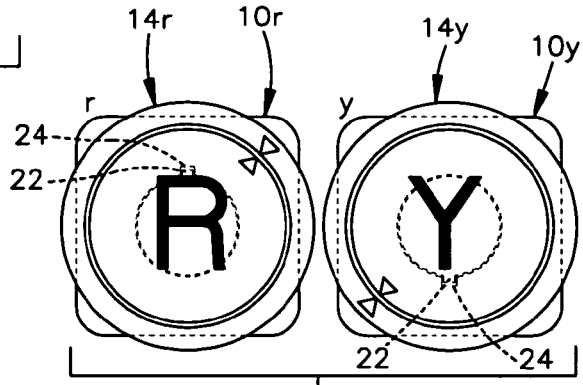
FIG. 9 is a view showing the labeled red and yellow buttons installed properly on the switches of FIG. 4.
Figure 10:
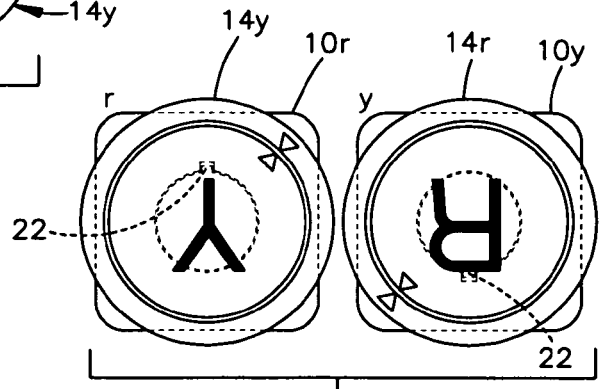
FIG. 10 is a view showing the labeled red and yellow buttons installed incorrectly (swapped) on the switches of FIG. 4.
Figure 11:
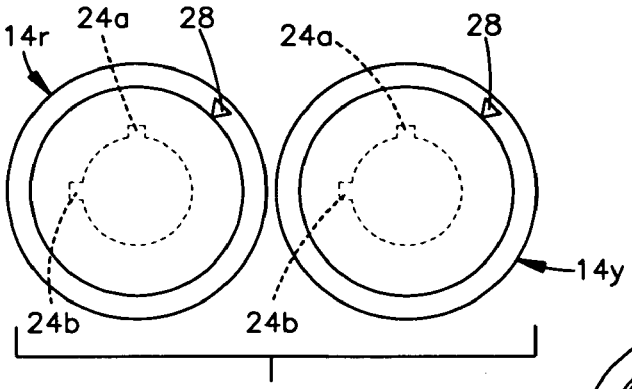
FIG. 11 is a front elevational view of two similar red and yellow control buttons in an identical orientation, without labels, the buttons having a plurality of detent positions for mounting on switches.

Putting the buttons 14*r* and 14*y* on the correct plungers, as shown in FIG. 9, provides two upright labels 30 and 32; while putting the buttons on the incorrect plungers, as shown in FIG. 10, makes it impossible to have the indicia on both buttons be upright or close to upright—if one is upright, the other is very wrong. This result occurs because of the specific orientations of the indicia of the labels 30 and 32 relative to the timing marks 34 of the labels, taken together with the 180° opposite orientations of the button orientation features 22 on the plungers 12*r* and 12*y* of the devices 10*r* and 10*y*. In sum, with the structures and shown in FIG. 1-10, if the assembler achieves upright text orientation, the labeled buttons necessarily are placed only on the correct plungers.

This assured upright positioning of the buttons on the plungers can be accomplished in this manner, if the switch assembly 16 does not need to be configured so that it could be mounted either vertically and horizontally in the vehicle 18 (FIGS. 1 and 2) and still have the indicia of the two labels 30 and 32 be both (a) upright and (b) on the correct devices.

As noted above, however, there is a requirement that the switch assembly 16 be able to be mounted in either a horizontal or a vertical (90° rotated) orientation in the vehicle 18. This is accomplished by providing (FIGS. 11-17) a plurality or range of engagement positions between button and plunger—that is, between the button orientation feature 22 of the plunger, on one hand, and the plunger orientation feature 24 of the button, on the other hand.

The detent range can be provided with multiple features on the button and one feature on the plunger, or vice versa. In the particular example shown in the drawings, which is only one of the various different ways in which this can be accomplished, each one of the buttons 14 shown in FIG. 11 has two slots (designated 24*a* and 24*b*) for receiving a rib 22 of a plunger 12, with the two slots being arrayed 90° apart.

Each detent range as a result includes two "correct" positions—a first one in which the button 14 is oriented correctly on the plunger 12 for the case in which the switch assembly 16 is to be mounted horizontally, and a second one in which the button is oriented correctly on the plunger for the case in which the assembly is to be mounted vertically. These two "correct" positions are at opposite ends of the 90° range of detent positions.

The "detented" engagement between the plunger 12 and the button 14 can be provided, for example, with a male detent feature on the button and a female detent feature on the plunger, or vice versa. Alternatively, it can be provided via a simple push on then detent (rotate) into correct rotational position movement. Or, alternatively, it can be provided by the use of any rotatable path with detents: push a button 14 on at a predetermined point, then rotate it to its to final detented position.

Because of the 90° range of engagement that is provided when the button 14 (FIG. 11) is installed on the plunger 12, the button has a number of possible positions of installation on the plunger. The assembler has to select the one position that provides upright text. The assembler also has to select, for the two buttons 14 as a pair, the positions that have the text of both labels standing upright in the same direction when the switch assembly 16 is oriented as needed.

With two devices being assembled, there are several possibilities, as shown schematically in FIGS. 12-15, when the two buttons are assembled onto the plungers.

Figure 13:
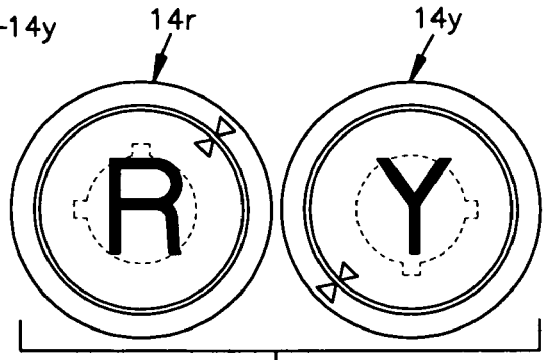
FIG. 13 is a view similar to FIG. 12 with the yellow button and label rotated 180 degrees to be upright.
Figure 12:
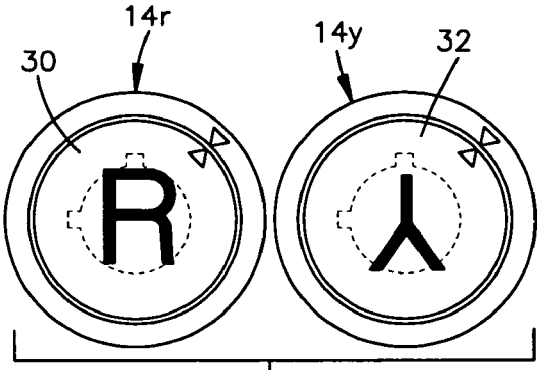
FIG. 12 is a front elevational view of the red and yellow labels as installed on the red and yellow buttons shown in FIG. 11, illustrating how the yellow label is thus upside down.
Figure 14:
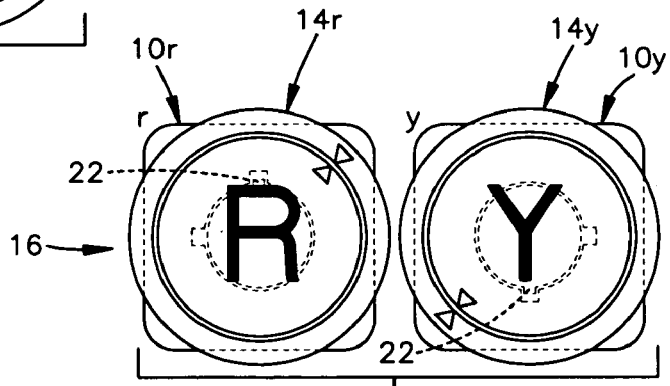
FIG. 14 is a view showing the labeled red and yellow buttons installed properly on the switches of FIG. 4, the switches begin disposed in a horizontal orientation of the type shown in FIG. 1.
Figure 15:
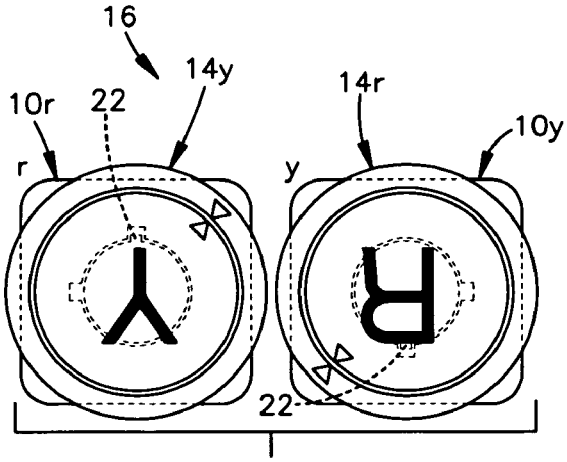
FIG. 15 is a view showing the labeled red and yellow buttons installed incorrectly (swapped) on the switches of FIG. 14.

FIG. 12 shows two labels 30 and 32 installed on two buttons that are oriented the same as each other, and FIG. 13 shows these two labeled buttons thereafter oriented with upright indicia on both. FIG. 14 shows the two labeled buttons 14*r* and 14*y* installed correctly on a horizontally oriented switch assembly 16 (as is done when assembling to the two devices 10*r* and 10*y* of FIG. 4, for example), and FIG. 15 shows the two labeled buttons installed incorrectly (swapped) on the horizontally oriented switch assembly. In FIG. 15, the indicia on the two button 14*y* and 14*r* are obviously in an incorrect orientation.

Figure 16:
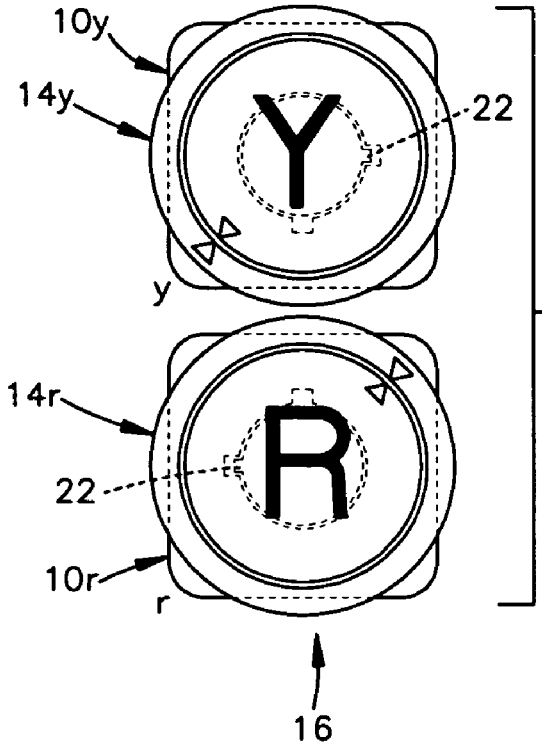
FIG. 16 is a view showing the labeled red and yellow buttons installed properly on red and yellow switches that are disposed in a vertical orientation of the type shown in FIG. 2.
Figure 17:
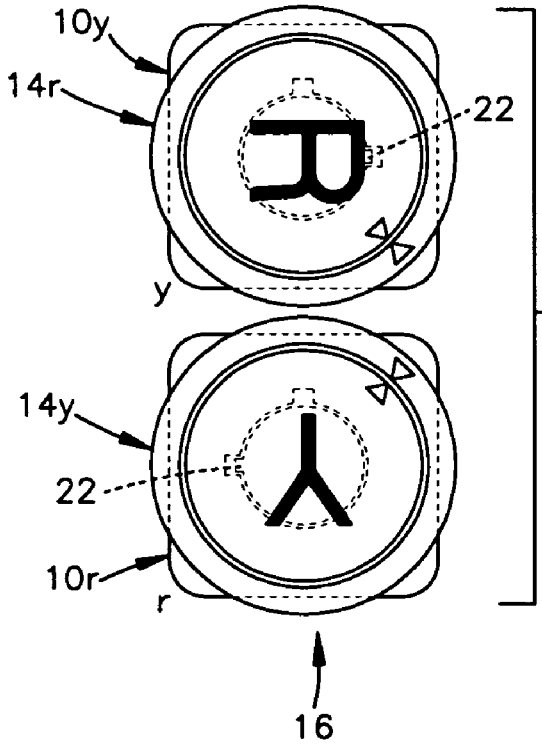
FIG. 17 is a view showing the labeled red and yellow buttons installed incorrectly (swapped) on the switches of FIG. 16.

FIG. 16 shows the two labeled buttons 14*r* and 14*y* installed correctly on a vertically oriented switch assembly 16, and FIG. 17 shows the two labeled buttons installed incorrectly (swapped) on the vertically oriented switch assembly. In FIG. 170, the indicia on the two buttons 14*y* and 14*r* are obviously in an incorrect orientation.

Thus, if the two buttons 14*r* and 14*y* are mistakenly put on the wrong plungers, (that is, if the R button is on the Y plunger and the Y button is on the R plunger), which could be called an "impostor" assembly, the indicia on the two labels can not both be upright—whether in the vertical (FIGS. 16 and 17) or the horizontal (FIGS. 14 and 15) orientation of the switch assembly 16.

It can be seen that for each "impostor" assembly, that is, with the buttons on the wrong switches, the two buttons 14*r* and 14*y* can be oriented so that their indicia extend in the same direction, as is desired. However, the range of possible rotational positions of each button 14 on its plunger 12 is such that there is no position within that range in which both (a) the text is upright and (b) both labels' texts extend in the same direction if the buttons are on the wrong switches.

In such a case, then, with the Y and R buttons being swapped on the two air flow control devices 10, this "impostor" positioning can not be fixed by keeping the buttons on the same plungers and rotating them thereon, to make all text on both buttons be upright. An assembler or operator, for example, can remove the buttons 14 and try to replace them upright on the same plungers 12, but will necessarily fail to produce a result in which both (a) the text is upright and (b) both labels' texts extend in the same direction. When this is noticed, the assembler or operator will realize that the buttons 14 are swapped (in an "impostor" position), and will know to fix the problem by removing the buttons completely from the incorrect plungers 12, and by then placing them onto the other/correct plungers.

The switches as manufactured may be identical to each other, to minimize expense. The buttons as manufactured may also be identical to each other. Only the labels need to be different from each other, as it is relatively easy and inexpensive to manufacture different labels.

From the above description of the invention, those skilled in the art will perceive improvements, changes, and modifications in the invention. For example, other types of air flow control device operators are usable. Thus, the invention is applicable to a plunger for an electric switch that controls an air valve; to a manually controlled electric switch located in, for example, a vehicle dashboard, that provides electric current to a solenoid (near or remote) or valve that the provides the control of the air flow. Such improvements, changes, and modifications within the skill of the art are intended to be included within the scope of the appended claims.

Having described the invention, we claim:

1. A method of installing first and second labeled buttons on first and second similar air flow control devices while ensuring that the first labeled button is installed on the first air flow control device and the second labeled button is installed on the second air flow control device, the method comprising the steps of:

providing at least two similar air flow control devices, each air flow control device having a plunger with a button orientation feature;

providing at least two similar buttons, each button having a label space, a plunger orientation feature and a timing mark;

providing first and second labels having different visual indicia, each label having a timing mark for association with a timing mark on one of the at least two similar buttons;

installing the first label on a randomly selected first one of the buttons by aligning the timing mark of the first label with the timing mark of the first button;

installing the second label on a randomly selected second one of the buttons by aligning the timing mark of the second label with the timing mark of the second button;

installing the first button on the first air flow control device so that the visual indicia on the first label is upright and the plunger orientation feature on the first button is engaged with the button orientation feature on the plunger of the first air flow control device; and installing the second button on the second air flow control device so that the visual indicia on the second label is upright and the plunger orientation feature on the second button is engaged with the button orientation feature on the plunger of the second air flow control device.

2. A method as set forth in claim 1 including the step of positioning the first air flow control device such that the first air flow device button orientation feature is in a zero orientation and positioning the second air flow control devices such that the second air flow device button orientation feature is 180° from the first air flow control device button orientation feature prior to installation of the buttons on the devices.

3. A method as set forth in claim 1 wherein: the step of providing at least two similar buttons comprises providing at least two buttons each having a range of plunger orientation features for enabling installation of the button on at least one of the air flow control devices in any one of a range of orientations.

4. A method as set forth in claim 3 wherein the range of plunger orientation features extends over about 90°.

5. A method as set forth in claim 1 wherein the step of providing at least two similar buttons comprises providing at least two buttons each having a 90° range of plunger orientation features for enabling installation of the button on at least one of the air flow control devices in any one of a range of orientations.

6. A method of installing first and second labeled buttons on first and second similar air flow control devices while ensuring that the first labeled button is installed on the first air flow control device and the second labeled button is installed on the second air flow control device, the method comprising the steps of:

providing at least two similar air flow control devices, each device having a device orientation feature and having a plunger with a button orientation feature;

providing at least two similar buttons, each button having a plunger orientation feature, a label space, and a timing mark associated with the label space;

providing first and second labels having different visual indicia, each label having a timing mark for association with a timing mark of a button;

installing the first label on a randomly selected first one of the at least two similar buttons by aligning the timing mark of the first label with the timing mark of the first button;

installing the second label on a randomly selected second one of the at least two similar buttons by aligning the timing mark of the second label with the timing mark of the second button;

orienting the first and second devices so that their device orientation features are 180° apart from each other;

installing the first button on the plunger of the first device so that the plunger orientation feature of the first button aligns with the button orientation feature of the first plunger and the visual indicia are upright; and installing the second button on the plunger of the second device so that the plunger orientation feature of the second button aligns with the button orientation feature of the second plunger and the visual indicia are upright.

7. A method as set forth in claim 6 wherein each one of the at least two similar buttons has a range of plunger orientation features that enables detented receipt of the button within a 90° range on a plunger of one of the first and second air flow control devices.

8. Apparatus comprising:

first and second similar air flow control devices, each device having a device orientation feature and having a plunger with a button orientation feature for receiving a button;

first and second similar buttons, each button having a plunger orientation feature for association with a device orientation feature of one of the control devices, a label space, and a timing mark associated with the label space;

first and second labels having different visual indicia, each label having a timing mark for association with a timing mark of a button when the label is applied to a button, the labels being configured such that the timing marks are oriented differently on the two labels when the visual indicia on both labels are upright.

9. Apparatus as set forth in claim 8 wherein each button has a range of plunger orientation features that enables detented receipt of the button within a 90° range on a plunger of one of the first and second air flow control devices.

10. Apparatus as set forth in claim 9 wherein the first and second buttons are identical to each other.

11. Apparatus comprising:

first and second similar air flow control devices each having a plunger for receiving a labeled button;

first and second similar buttons, each having a label space for receiving a label;

first and second labels having different visual indicia and being adapted for placement in the label spaces of the first and second buttons; and means for ensuring that the first labeled button is installed on the first air flow control device and the second labeled button is installed on the second air flow control device.

12. Apparatus as set forth in claim 11 wherein the first and second buttons are identical to each other.

13. Apparatus as set forth in claim 11 wherein each one of the first and second air flow control devices has a button orientation feature on the plunger, the button orientation feature of the devices being oriented differently when the devices are oriented differently.

14. A method comprising the steps of:

providing first and second similar air flow control devices each having a plunger with a button orientation feature for receiving a labeled button;

providing first and second similar buttons, each having a plunger orientation feature for association with the button orientation feature of at least one of the first and second similar air flow control devices, a label space for receiving a label and a timing mark associated with the label space;

providing first and second labels having different visual indicia, having a timing mark for association with the timing mark of the button and being adapted for placement in the label spaces of the first and second buttons;

installing the labels on the buttons; and ensuring that the first labeled button is installed on the first air flow control device and the second labeled button is installed on the second air flow control device.

15. A method as set forth in claim 14 wherein said ensuring step comprises the steps of: orienting the first and second air flow control devices such that the button orientation feature of the first air flow control device is at a zero orientation and the button orientation feature of the second air flow control device is at an orientations 180° from the button orientation feature of the first air flow control device prior to installation of the first and second buttons thereon, and configuring the first and second labels such that the timing marks are oriented differently on the two labels when the visual indicia on both labels are upright.

* * * * *